US005787639A

United States Patent [19]

Lamore, Jr.

[11] Patent Number: 5,787,639

[45] Date of Patent: Aug. 4, 1998

[54] DOOR AND FRAME MOUNTING ENABLING DOOR HANGER BOLT ASSEMBLY

[76] Inventor: Larry Lamore, Jr., 57 Marconi Ave., Iselin, N.J. 08830

[21] Appl. No.: 879,721

[22] Filed: Jun. 20, 1997

[51] Int. Cl.[6] ..... E06B 1/00

[52] U.S. Cl. ..... 49/380

[58] Field of Search ..... 49/380; 206/321, 206/325

[56] References Cited

U.S. PATENT DOCUMENTS

| | | | |
|---|---|---|---|
| 2,720,308 | 10/1955 | Howell | 49/380 X |
| 2,728,956 | 1/1956 | Jackson | 49/380 |
| 5,159,782 | 11/1992 | Sales | 49/380 |
| 5,562,315 | 10/1996 | Sales | 49/380 X |
| 5,718,082 | 2/1998 | Mori | 49/380 |

*Primary Examiner*—Jerry Redman
*Attorney, Agent, or Firm*—William T. Hough

[57] ABSTRACT

For a prehung door unit of door and door frame, a locking assembly lock together the prehung door units irreversably until after permanent final installation, a portion of the assembly is removable from the door's latch bore through the doors lockset bore. The assembly achieves its benefits by thus allowing factory "bench" final settings of accurate door mounting parameters of plumbing and leveling fixed relationships relative to its mounting frame. The fixed factor bench plumbing and leveling settings are maintained by the installed assembly before, during and subsequent to artisan mounting the fixed immobilized movement of the frame within a door jamb, precluding heretofore necessity of artisan time-consuming and costly plumbing and leveling a frame mounted door during installation of the frame and its door of heretofore prehung door units.

19 Claims, 5 Drawing Sheets

Figure 3:
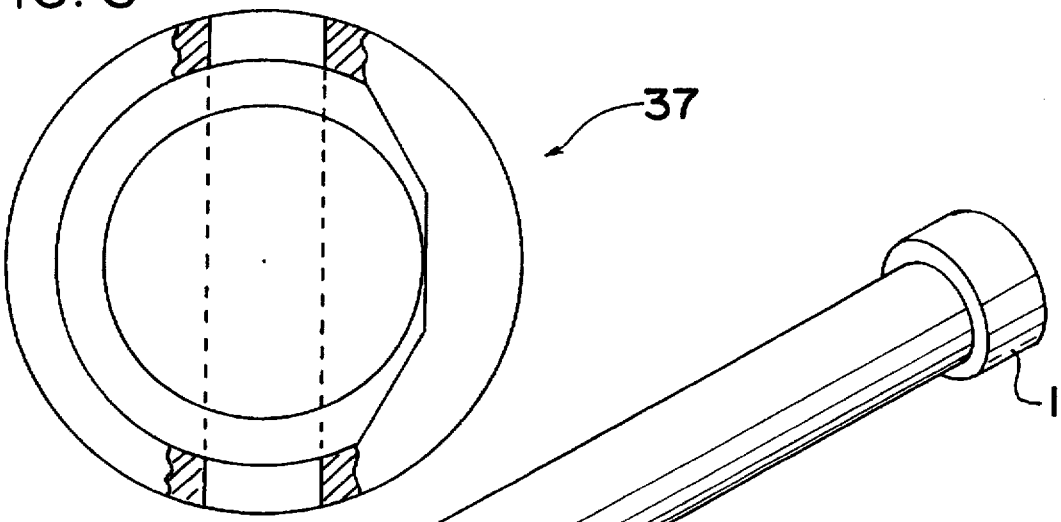

FIG. 1
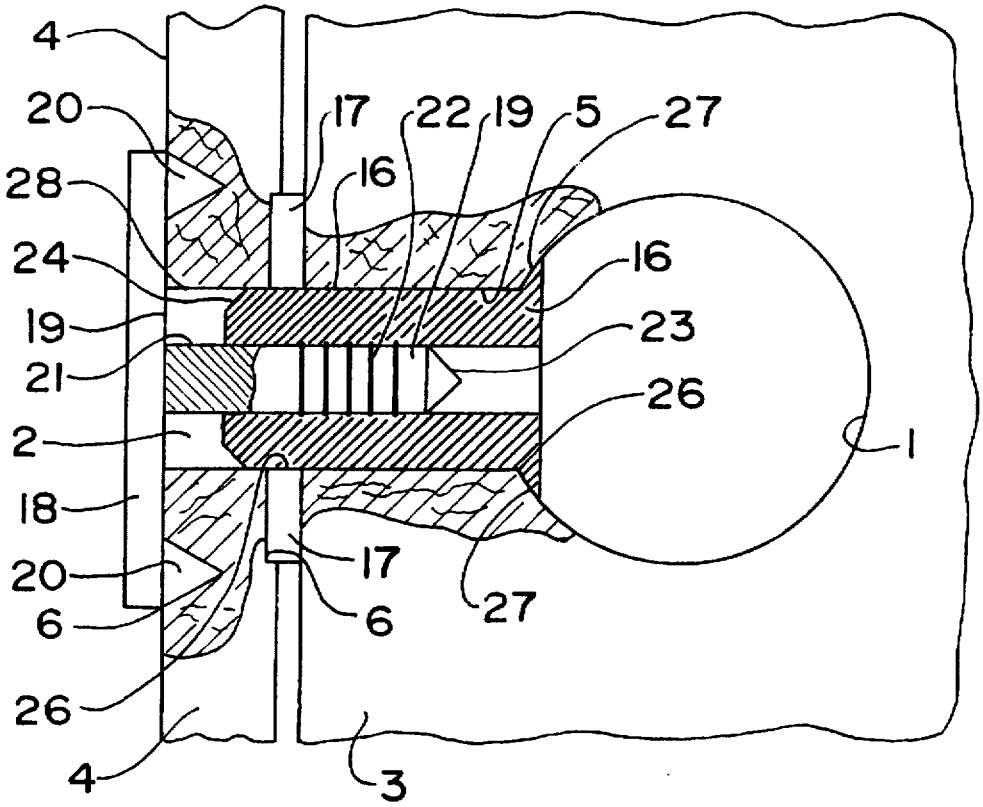
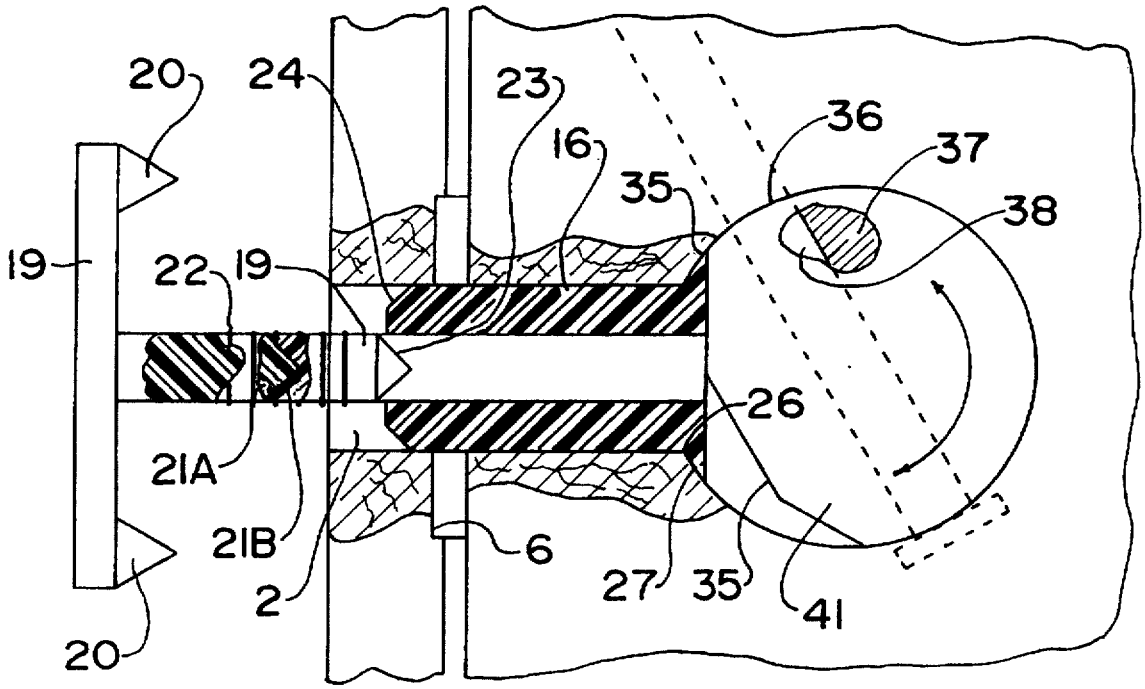
FIG. 4

FIG. 7
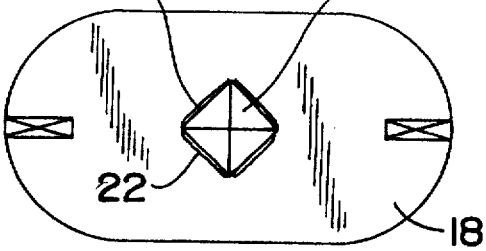
FIG. 8
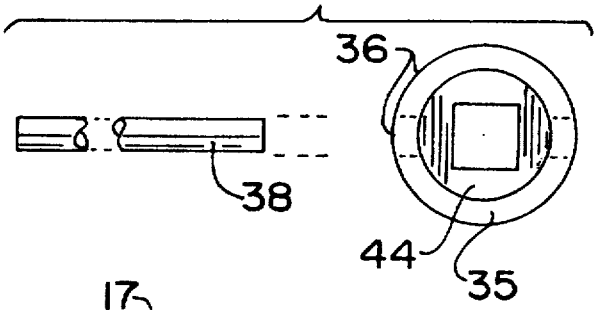
FIG. 10
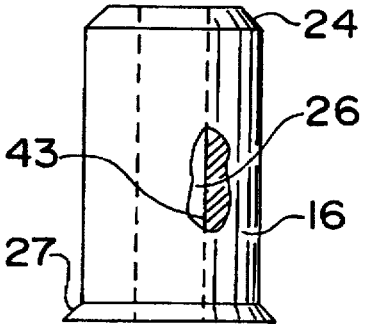
FIG. 11
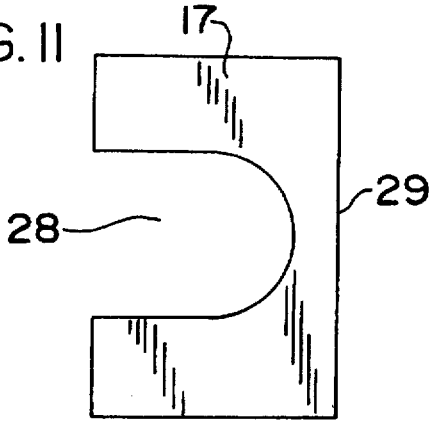
FIG. 12
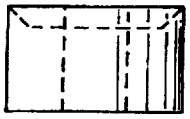
FIG. 9
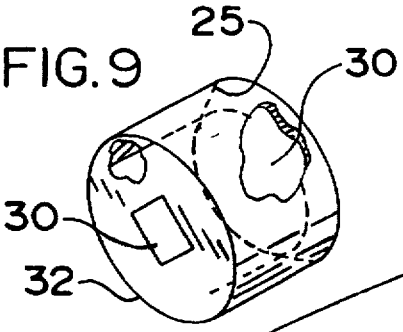
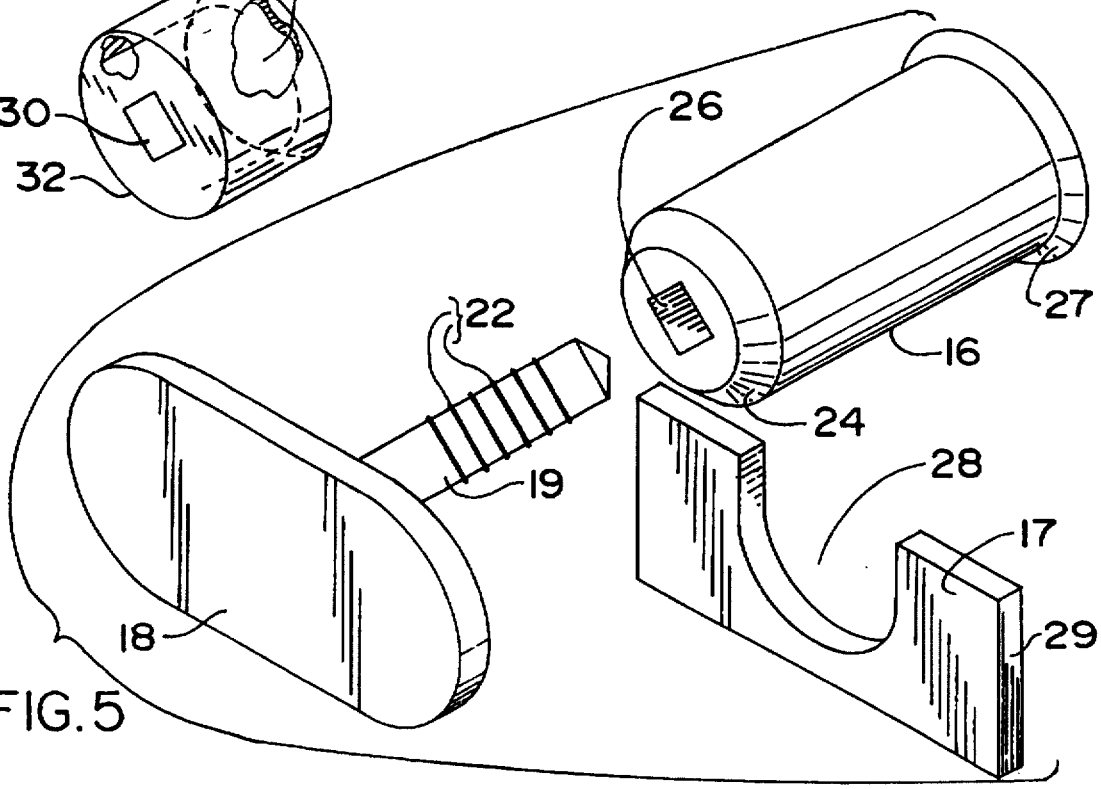
FIG. 5

DOOR AND FRAME MOUNTING ENABLING DOOR HANGER BOLT ASSEMBLY

THE INVENTION

Description of the invention necessarily embodies critical considerations of each of prior art and background and objects of the invention, as follow.

A. PRIOR ART

A prior art search of:

U.S. Patent Office Class 49, sub-class 380, and Class 52, sub-class 213.

While no relevant prior art was located, the sole patent found of interest is U.S. Pat. No. 5,159,782. That patent discloses does not characterize the objects to which the present invention is directed, nor does that patent's disclose, characterize nor confront the problems to which the present invention is directed nor the solutions thereto. The disclosed device in its entirity of that patent and with its divergent structure could not possibly obtain the objects of the present invention. More particularly, that patent is directed exclusively and solely to the mere intermittent locking/securing of the door into a frame during the course of its shipping, not accomplishing nor capable of accomplishing objects of the present invention. That patent's device solely prevents the unmounted vertical edge of the door to be shipped, from swinging to (back) and fro (forth) in its frame during transit shipping and handling thereof prior to any subsequent contemplated mounting within a wall space after receipt thereof from the shipper.

B. BACKGROUND

While the shipping stability accomplishment of the prior art patent of the preceding paragraph is likewise accomplished by the present invention, such mere anchoring during shipping is a mere supplemental benefit, even though the present invention additional avoids the necessity faced by the aforenoted prior art patent of removing that patents removable throw-away bolt 42 prior to installing the door frame to and against (attachment to) one of two spaced apart defining wall space (wall opening) wall liner vertical studs. It in fact is the mounting within that opening encounters the many time consuming problems of mounting and leveling a door frame and door thereof that embodies the many problems and difficulties to which the present invention is directed and which problems and difficulties are overcome by the present invention.

More particularly, prehung doors are manufactured as predrilled, premortised door and frame unit, with hinges installed securing one leg of the frame to one edge of the door. This leaves head frame head and opposite frame leg nonstationary. Both door and frame, bores and mortise are designed to accept hardware for lockset, latch and strike plate. A lockset bore generally has about a 2 and ⅛ inch diameter hole in a broad face of the door with the lockset bore extending parallel with the thickness door edge extending between the opposite broad faces of the door. The center of the lockset bore is in the trade called a "backset", being the center of the lockset bore. The latch bore refers to the hole in the unmounted upright side edge of the door, the latch bore extending parallel to and between the opposite broad faces of the door. The latch bore ranges generally about ⅞ inch to about one inch diameter hole positioned in a center of the thickness of the door and aligned perpendicularly with the vertical and horizontal center of the lockset bore in a door; the latch bore also is located in that area of the frame aligning the door with the frame.

Residential and commercial pre-hung doors are most commonly constructed of wood. This is for both interior and exterior applications. Pre-hung doors are constructed to fit into all openings which are usually marginally larger than pre-hung unit dimensions. This is to allow a pre-hung to be installed with closer tolerances in respect to level, plumb, and door to frame operating margins uniform as a finished wall mounted product.

The pre-hung doors are usually manufactured and shipped with some type of retainer (even as simple as a nailed strip extending over a face of each of the door and the frame) to keep the door and frame from falling apart nor moving one relative to the other during the course of shipping and/or transient. These retainers must be removed "prior to" installation of the pre-hung door within its unit frame. The most commonly used devices are one or more of nail(s) unsightly driven through strike side of a frame into an edge of the door, or strip(s) of wood nailed or stapled across a hinge face of the overall unit (door and frame), from hinge leg of the frame to a strike leg of a frame. A strike leg of a frame is the vertical leg of the frame where a portion of the latch mechanism is accommodated, to maintain the door in a closed position while so engaged; the operating relationship of door to frame is "not" engaged nor maintained. The use of these retainers will leave holes, splits and scratches in visible area of pre-hung units (either and/or both the door and frame) when mounted in the wall space as a finished product—requiring even additional extra work of the installing artisan in his attempts to mask, cover and/or hide these (such) scars and/or man-made imperfections. The aforenoted use of such retainers in no manner nor way aid nor contribute to a final nor successful installation of such aforenoted pre-hung doors as frame door unit(s).

The background of the invention accordingly includes objects directed to avoiding and/or precluding the foregoing shipping scar(s) and/or man-made imperfections, together with concurrently achieving ends inclusive of both avoiding such prior problems together with heretofore unheard-of novel functions and/or achievements of easy, simple and quick installation of prehung units aforenoted. Accordingly, one object of the present novel invention "door and frame mounting enabling door hanger bolt assembly" concurrently both prior to "and during" installation. Such object include the goal of utilizing for the first time ever the lockset, latch and mortise for strike plate for the strike plate, both the maintain the prehung frame and door thereof as a rigid unit both setting and maintaining "finished margins" (final installation margins) between the prehung frame and door thereof, set and maintained prior to and during both shipping and final installation between the aforenoted two spaced apart defining wall space (wall opening) wall liner upright (vertical) studs. Accordingly, while an object of the invention is to obtain such a setting structure, a more important and never before achieved object is to include an assembly that additionally maintains during installation preset finished gauged margins, leveling, and verticality of and between the prehung door and its mounting frame, together with the cost economy of avoiding achieving such ends for the first time solely at and during the installation phase. Accordingly, an associated or related object is by utilization of the present inventive combination, to make possible a preshipping setting of totally correct margins (squaring and achieving parallelism thereof), leveling, verticality/plumbing thereof, and the like for a properly subsequently installed prehung frame and door thereof, at a pre-installation and pre-shipping point in time, an achievement never heretofore contemplated nor achieved. Accordingly, an object of the invention is to obtain a preshipping "permanent" installation of a novel combination that achieves installation settings to be maintained by the non-removable elements of the combination until disengagement of a portion of the combination "subsequent to" total final precision installation of the prehung unit between the aforenoted two spaced apart defining wall space (wall opening) wall liner upright (vertical) studs.

Another object is to include a supplemental extension element that adapts the combination to be utilized for latch bore diminsions greater (longer) than typically normal.

Another object is to obtain a novel sub-unit and/or sub-unit combination utilizable to facilitate removal of a sub-portion of an installed locking and immobilization combination to thereupon thereafter free the door to swing within its frame subsequent to the standard installation of the frame between the aforenoted two spaced apart defining wall space (wall opening) wall liner upright (vertical) studs.

Another object is to achieve novel structure enabling easy and speedy removal during the releasing phase, following installation.

Another object is to obtain a novel wrench and/or detachable handle thereof for utilization enabling easy and speedy removal during the releasing phase, following installation.

Other objects become apparent from the following disclosure of the invention and its implementation.

C: BROAD INVENTION

In light of the foregoing prior art of background, the invention in its broadest embodiment, is a door hanger bolt assembly combination.

The combination includes broadly a) an elongated tubular (or cylindrical) member, b) a stud base member, together with further improvements thereto and preferred embodiments thereof.

a) The elongated tubular member has a substantially cylindrical outer shape, an open top end and an open bottom end and includes a substantially centered distal bottom structure forming an upwardly extending first inner passage extending from said open bottom end distally toward said open top end, and includes a substantially centered distal top structure forming a downwardly extending second inner passage extending from said open top end distally toward said open bottom end, said open top end being formed by at least one non-circular structure that is a part of said downwardly extending second passage, said elongated tubular member having a cylindrically shaped outer wall having a predetermined outer diameter at least as small as a diameter of the predetermined door's cylindrically shaped latch bore.

b) The stud base member has a forward face of a radially outwardly extending linear predetermined dimension greater than a diameter of a predetermined door's cylindrically shaped latch bore of a door's latch bore structure. The stud base member is adapted to be mounted across a strike leg of a door frame's though space strike aperture having a door frame strike aperture diameter at least as large as said predetermined outer diameter of said cylindrically shaped outer wall. The forward face includes door frame strike leg mounting structure (and mechanism thereof) enabled to mount the forward face over the door frame's through space strike aperture onto a door's frame strike leg mounting outwardly facing upright surface. A stud elongated member non-revolvably is mounted on the forward face. The stud distally elongated member has a cross area shape and elongated member exterior walls thereto retainably and mountably insertable (or inserted) into the upwardly extending first inner passage. The elongated member exterior walls include locking structure (and mechanism thereof for) securing the stud elongated member within the first inner passage.

As a first improvement and preferred embodiment on the preceding broad invention, there is included a shim plate having opposite faces. A through space extend through the opposite faces. The through space has a substantially circular shape with a shim hole diameter at least as large as the diameter of the above described door's cylindrically shaped latch bore. The shim plate is mountable between i) the style (edge) of a door and ii) the strike leg of a door frame. The elongated tubular member is insertable through the shim hole, between strike legs of a door and strike legs of a door frame.

As a second improvement and preferred embodiment on the first preferred embodiment, and alternatively on the preceding broad invention, at least a major distal end portion of the stud elongated member is removable from attachment to at least one of the forward face and a proximal end of the stud elongated member.

As a third improvement and preferred embodiment on the second preferred embodiment, and alternatively on the preceding broad invention, the locking structure (and mechanism thereof for) includes one of male and female threads mounted on the stud elongated member. There is further included a remaining mateable one of the male and female threads mounted on walls of the second inner passage. Such arrangement enables the male and female threads to be detachably screwably mateable to and detachable from one another.

As a fourth improvement and preferred embodiment on the third preferred embodiment, and alternatively on the preceding broad invention, the locking structure (and mechanism thereof for) comprises the stud elongated member includes lineally aligned proximal and distal end portions, shearably connected by an intermediate shearable stud portion such that the distal end is shearable by a annularly twisting thereof relative to the proximal end portion held stationary by its mounted state within a latch bore of a door.

As a fifth improvement and preferred embodiment on the fourth preferred embodiment, and alternatively on the preceding broad invention, the first and second inner passages are serially and lineally interconnected.

As a sixth improvement and preferred embodiment on the sixth preferred embodiment, and alternatively on the preceding broad invention, the shim space communicates with exterior lateral space. Additionally, the shim plate has a substantially semicircular space extending through an edge of the shim plate.

As a seventh improvement and preferred embodiment on the sixth preferred embodiment, and alternatively on the preceding broad invention, the door hanger bolt assembly includes an extension member correspondingly attached to a bottom half of the elongated tubular member lineally detachably mountable on the open bottom end.

As an eighth improvement and preferred embodiment on the second preferred embodiment, and alternatively on the preceding broad invention, the locking structure (and mechanism thereof for) includes at least one raised wedge-structure raised from a lateral face of the stud elongated member. The raised wedge-structure is sufficiently raised as to securably engage an inner tubular face of the elongated tube member. Thereby the elongated tube member is retained in the mounted state.

As a ninth improvement and preferred embodiment on the seventh preferred embodiment, and alternatively on the preceding broad invention, for use in pressing-against and thereby temporarily supporting the aforenoted elongated tubular member in its inserted state there is provided a novel cycloidal male wrench more preferably a torque wrench) during its engagement with the stud base member, whether the engagement was by wedge, thread or shearble structure aforenoted.

D. BRIEF DESCRIPTION OF THE DRAWINGS

FIG. 1 diagramatically and symbolically illustrates in elevation plan view of a section of the door and frame with an embodiment of the novel combination of the stud base and stud thereof and barbs thereof and of the positioned shim all installed relative to and/or within the latch bore portions of the door and of the door frame, as seen in a cut-away and in-part cross-sectional view of portions of the door and the door frame.

Figure 2:
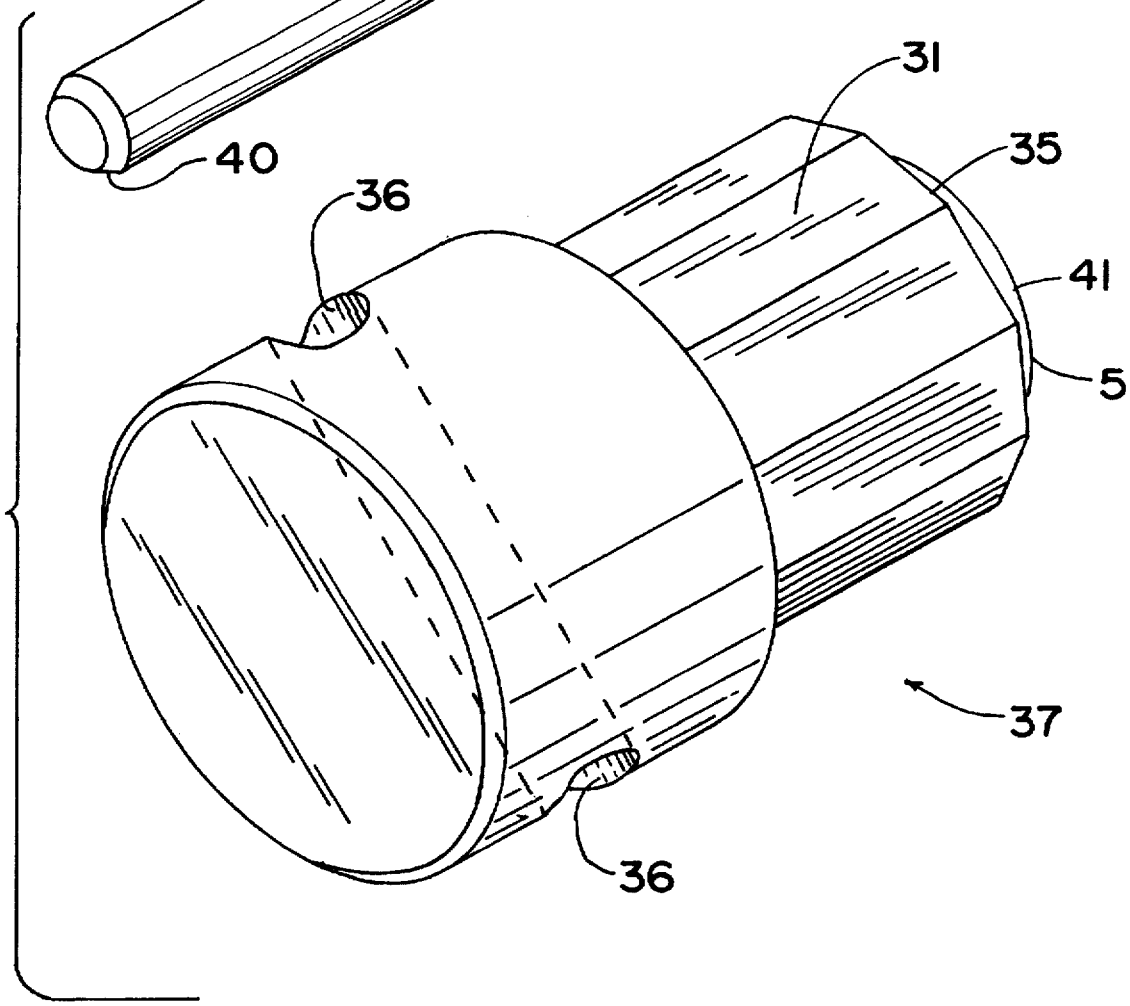

FIG. 2 diagramatically and symbolically illustrates a side perspective view in exploded view thereof, of a cycloidal wedge and its elongated cylindrically shaped handle.

FIG. 3 diagramatically and symbolically illustrates in top-end elevation plan view of a top (engagement) end of the cycloidal wedge of FIG. 3, with partial cut-away above its handle mounting portions of the top end thereof.

FIG. 4 diagramatically and symbolically illustrates in elevation plan in-part exploded view substantially corresponding to the FIG. 1 view except illustrating the stud base and the barbs thereof and the stud portions itself, in a partially inserted partially mounted state.

FIG. 5 diagramatically and symbolically illustrates in a perspective exploded view of the assembly elements of FIG. 4.

Figure 6:
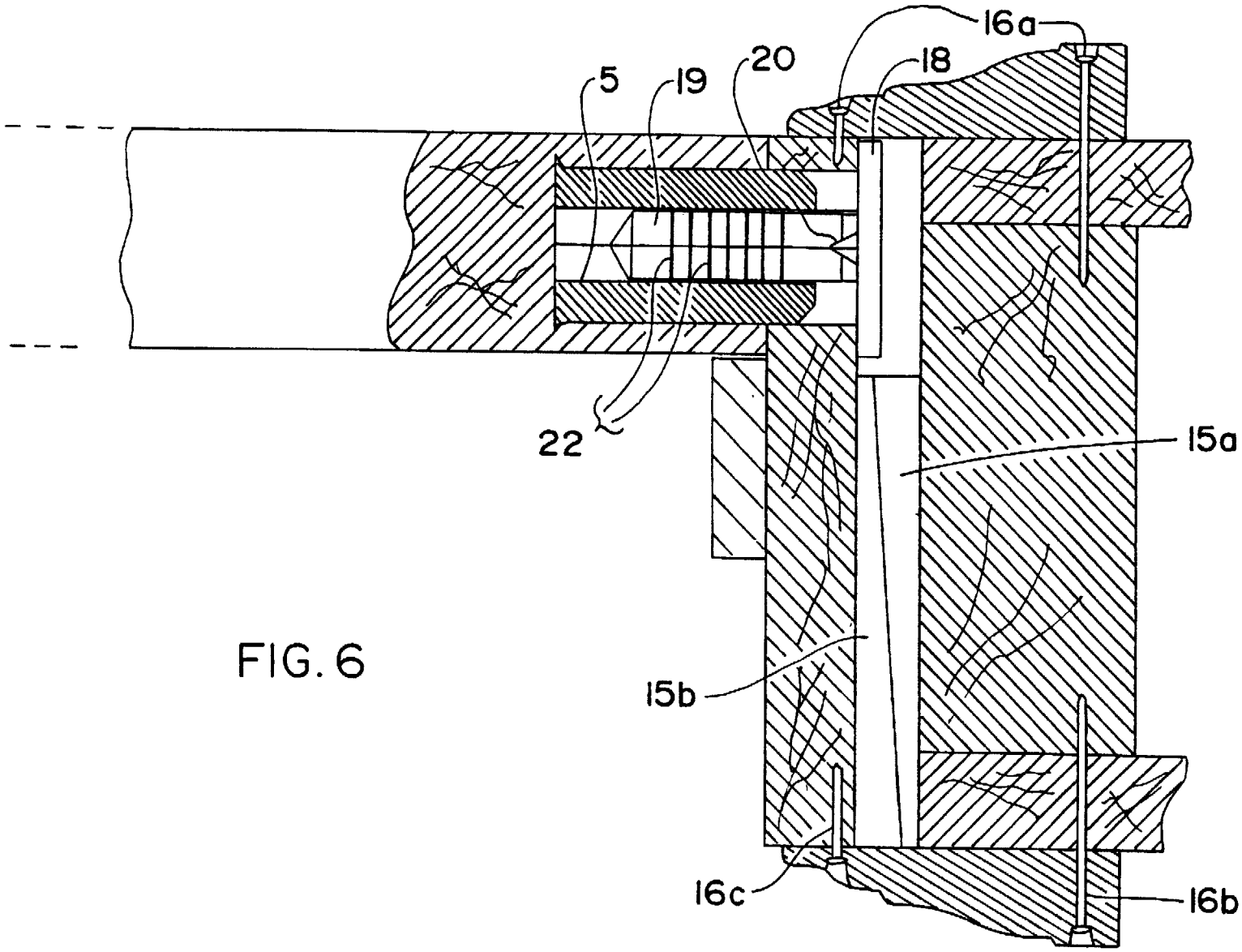

FIG. 6 diagramatically and symbolically illustrates in elevation top partial cross-sectional view plan view, of the illustrated elements of FIG. 1 with the door frame in a fully mounted state relative to the mounting Liner stud of the open wall and its applied oppositely mounted drywall panels and oppositely mounted molding (casing) 11 secured to each of the door frame and the door and the liner stud.

FIG. 7 diagramatically and symbolically illustrates in elevation plan view of the stud base and its here illustrated distal end of the upwardly extending stud portions (shank) thereof, and stud base barbs.

FIG. 8 diagramatically and symbolically illustrates in elevation plan exploded view, a bolt engageable end of the cycloid wrench having the dismountable elongated handle mounted therein—shown in its exploded (non-inserted) view.

FIG. 9 diagramatically and symbolically illustrates a perspective view of an accessory extension bushing adapted to simulate in use, an extension of the bolt of the assembly combination.

FIG. 10 diagramatically and symbolically illustrates in elevation side plan view of an upright bolt element of the invention, with partial cut-away.

FIG. 11 diagramatically and symbolically illustrates in elevation plan view of a face of a preferred shim utilized as a part of a preferred assembly combination.

FIG. 12 diagramatically and symbolically illustrates in elevation plan side view of the accessory extension bushing of FIG. 9.

Figure 13:
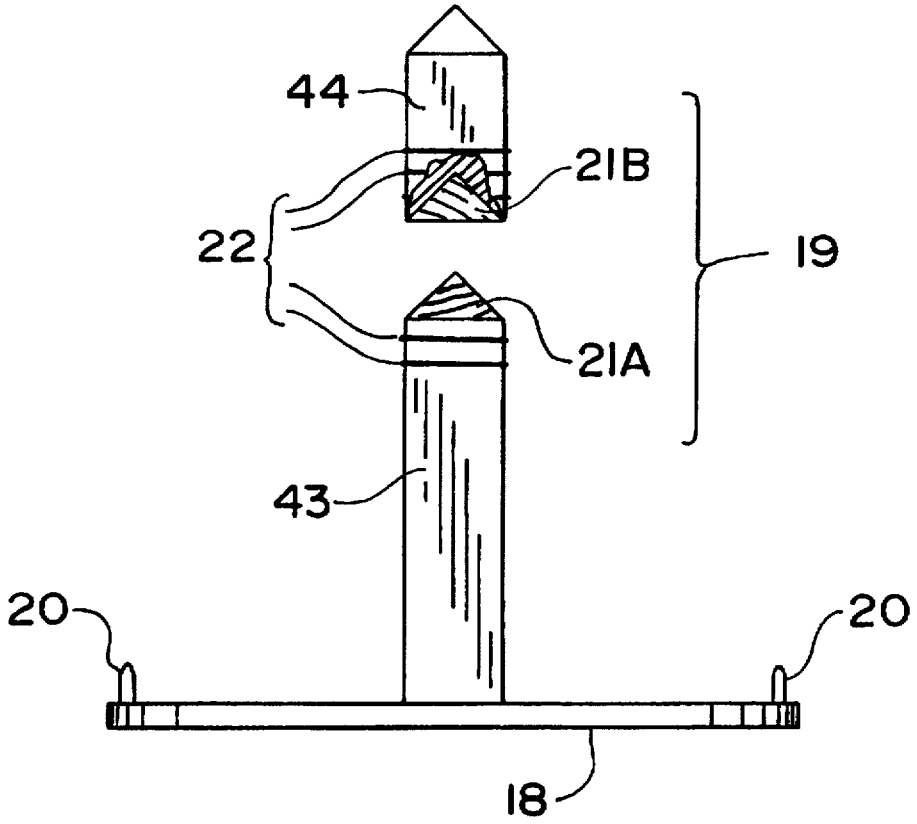

FIG. 13 diagramatically and symbolically illustrates in elevation plan exploded side view with partial cut-away, male and female mateable separate proximal and distal stud shank portions.

E. DETAILED DESCRIPTION OF THE INVENTION

The preceding broadly described invention is an intermittent retaining device as a rigid unit maintainable of preset parameters above discussed until after permanently set, until "after" completion of installation the the entire unit of the prehung door (frame door) combination unit. The combination above described, utilizes the bores for lockset, latch, and mortise for the strike plate such that there is maintained frame and door as a rigid unit maintainable of the aforenoted preset parameters and/or settings. Finished margins between the door frame and the door are preset and thereafter maintained prior to and essentially "during" installation, thereby enabling molding or casing to be applied to the face of a pre-hung unit—not heretobefore contemplated nor possible; such procedure utilizing the present invention is a part of the preshipping (i.e. as a bench preparation and operation)—applicable to either face of the unit. The rigid and on-going connection via the present invention installed connections, prevent miters and/or butt connections of applied molding and/or casing, from being disturbed, as well as strike leg, head and door from destructively flopping uncontrolably either prior to and especially and importantly during the installation procedure and work thereof. As a part thereof, in such utilization of the present invention, the door frame is essentially maintained flush with the door broad surface prior to and especially during installation. Moreover, for the first time "throughout and after" the installation phase, as a result of the presetting (aforenoted) being maintained throughout the installation, the unit having been rigidly connected in its squared state and parallel state to each other (frame and door hung therein) throughout the installation, all that is necessary after the installation is that plumbing and leveling of one edge of the frame door unit, followed by removal of the locking element of the invention combination, more fully describe hereinbelow. The entire installation procedure for the prehung and preset frame and door combination embodying the present invention is the reduced installation work and installation time and increased ease of installation, devoid of cumbersome attaining of totally numerous initial setting aforenoted (as compared to pre-invention being devoid of benefits of factory bench setting permanently retained prior to and during installation).

Described in greater detail hereinbelow, a distal end of a previously simply installed stud element 19 together with its "mounted" (locked) central passage-containing (or through-space central passage thereof) bolt 16 from its locking position and state, is/are quickly and simply removable each and both concurrently from a recessed space (termed frame lock bore) of the door frame mortise area 6 (that normally would seat a strike plate, by withdrawal thereof from the lockset distal portion 2 through the lockset bore. This is movement is opposite to the factory "bench" installation of the bolt initially by way of the same lockset bore to its mounted position and state within the latch bore proximal portion 5 of the door and latch bore distal portion 2 of the frame 4.

The door and frame mounting enabling door hanger bolt assembly, hereinafter termed "bolt assembly", is easily installed by first inserting bolt 16 into latch bore proximal portion 5 through access of lockset bore 1 aligning latch bore proximal portion 5 with latch bore proximal portion 5 in door 3. Thereafter place the stud 19 and base 18 through latch bore distal portion 2 in frame 4 into square receiving hole 26 in bolt 16 as far as possible by pressing with ones fingers. Next place shim 17 between the door 3 and frame strike leg 4 into strike mortise 6 of channel 28 with shim 17 surrounding bolt 16 perpendicularly; this guages and maintains correct spacing between head and strike legs of the frame and door, since the door is previously secured to an opposite leg of the frame adjacent and by conventionally hinges (not shown). Next FIG. 8 cycloid wrench in the form of a male wrench, namely the cycloid wedge 37 is placed into lockset hole 1 of the door. Inserting handle 38 into hole 36 of the cycloid wrench wedge 37. Pull handle 38 causing it to turn (left or right) contacting wedge face 35 with bolt face 27 tightly against interior edge lockset bore 1. The bolt face 27 of FIGS. 1, 4, 9 and 10 constitutes a forward face of a radially-outwardly extending linear predetermined dimension greater than a diameter of the predetermined door's cylindrically-shaped latch bore. Next, while bolt 16 is held in place, stud base 18 is struck with a while bolt 16 is held in place, stud base 18 is struck with a mallet sufficiently to drive base stabilizing barbs 20 tightly into door frame 4 and stud shaft 19 with unidirectional barbs 20 tightly into door frame 4, and stud shaft 19 with unidirectional barbs or rings 22 into bolt receiving hole 26. This procedure is completed when enough friction exists between door, shim, and frame so that the shim 17 cannot be extracted easily. Remove wedge 37 from lockset bore 1.

Bushing 32 is an accessory used to accomodate doors with backsets where length of bolt required would be too long to insert through the lockset bore as one piece. Multiple sections must be used in such case to maintain a portion of retaining device passing through and connecting the latch bore in door 5 shim channel 28 and the door latch bore 5. Bushing 32 as a lengthening accessory has a female inward camfer 25 conforming to and seatable of the male camfer 24 of the bottom (distal) end of the (tubular hole 30) bolt.

This prevents lateral movement of the door and frame relative to each other. Bushing 32 should have (preferably has) an outside diameter with close tolerance to bores 2 and 5 in order to prevent this lateral movement, as well as to allow sliding movement through latch bores 2 and 5 by finger manipulation. This also equally applies to the bolt's diameter as well.

Flange 27 diameter of bolt 16 should preferably be large enough to significantly maintain position and tension at an interior edge of the lockset bore 1 devoid of significant defirmation to flange 27 or bores 1 and 5, while maximizing body length of the bolt 16 that can be inserted in the lock bores 2 and 5 through access by lockset bore 1.

Chamfer 24 of should substantially closely conform to an arc of lockset bore 1. Chamfer 24 of bolt 16 is to aid in alignment of the bolt 16 within latch bores 2 and 5. Angle of the camphor should be such that the end of the bolt 16 is substantially at an entrance to the latch bore proximal portion 5 and flange 27 is substantially at a point closely adjacent (just before touching) an opposite edge of the latch bore proximal portion 5; a corner is substantially formed by a face of the door 3 and a wall of the latch bore distal portion 2.

A substantially square faced receiving hole 26 in bolt 16 should substantially exist continually from end to end of a lateral center of the bolt 16. Size and shape of the receiving hole 26 may optionally be that of commonly found in right angle square-drive prior existing conventional wrenches (i.e., ¼ inch or ⅜ inch drive socket wrench or L-shaped key). Bushing 32 should have a hole 30 of substantially equal size and shape as receiving hole 26 in bolt 16. Recessed chamfer in bushing 32 should be substantially a female mate to camfer 24 of bolt 16.

Shim 17 should have a thickness of substantially the sum of aforenoted strike mortise and substantially required finish operating margin between the door 3 and the frame 4. Channel 28 of shim 17 should substantially conform to shape and size of outer dimension of a cross section of bolt 16 while depth of channel 28 allows shim 17 to slide far enough into the aforenoted strike mortise as to enable shim 17 to substantially reach an entire width of the aforenoted strike mortise 6 while having contact with bolt 16. Length of shim 17 from edge(s) 29 should allow the shim to fit substantially snugly into the latch end aforenoted mortise. With close tolerances given to measurements of channel 28 and length of shim 17 from edge(s) 29, added holding power is given to a retainer, substantially parallel to the frame 4 and door 3.

Stud base 18 substantially has shaft 19 of a size and shape to substantially fit as a male component in receiving hole 26 in bolt 16. Stud shaft 19 substantially should have an area with unidirectional barbs and/or increased diameter 22 such that when stud shaft 19 is driven into final position relative to receiving hole 26, sufficient friction is created to substantially tightly fasten frame leg 4 to door 3. The stud 19 in one embodiment has a shaft 19 of size and shape to substantially fit as a male component within hole 26 of bolt 16. Stud shaft 16 has an area thereof with unidirectional barbs 22 and/or of increased diameter so that when stud shaft 19 is driven into a final position relative to receiving hole 26, there is sufficient friction created to tightly fasten frame leg 4 to door 3. The stud shaft 19 in one embodiment has sufficient relief cut (reduced diameter) at stud shaft proximal location 21 (here illustrated near the mounting base 18) as to reduce cross-sectional area reducing calculated sturdiness thereof as a means of achieving a precontrolled reduced shear strength plane, leaving sufficient cross sectional area such that there is maintained tensile strength of the stud shaft sufficient to maintain strike of frame 4 fastened to door 3 during shipping and installation of the overall assembly unit/locking combination as installed.

In an alternate reuseable unit of the locking combination, as aforenoted as an alternate to relief cut of location 21, there may be instead utilized a preferred embodiment utilizing male-female mating portions of linearly aligned proximal and distal portions 21A and 21B respectively of the stud shaft.

Base 18 of the stud fastener has a width dimension such that edges of the base once installed do not extend significantly (inoperatively) past an edge of the door frame 4 such that it would interfere with installation of casing and/or molding. Length of base 18 is sufficient length that embedded barbs 20 embedded into (within) door frame 4 such that they remain fastened (embedded) when counter torque is applied to cause shearing of stud 19 at location 21.

Barbs 20 of base 18 are located at the very edge to maximize resistance to counter torque applied to shear or unscrew stud 19 from base 18. Barbs 20 should not exceed thickness of frame 4, so as to not penetrate a finished face of the frame, but should be long enough to to maintain base 18 permanently as it will remain to cover latch hole 2 in frame 4.

Optimally a special tool is required during installation to hold the bolt in place while the stud and base 18 are struck with a mallet not illustrated) as aforenoted. This is important since friction is one of the forces that maintains all of the components in their respective positions until removal of the bolt 16. A tool that may be used is a cycloidal wedge 37 made with a flange 33 such that it may be rotated on a plane parallel to a face of the bolt 16. It preferably has a hole 36 to accept a handle 38 that preferably slides from end to end, to accomodate left or right hand use. The cycloidal wedge 37 preferably has a face 34 that allows the wedge 37 to slide freely in andout of lockset bore 1 with bolt 16 in its installed position with respect to latch bores 2 and 5. Two substantially equal faces 35 should exist so that when wedge 37 is rotated, contact is made by face 35 with the bolt opposing face of flange 27. A contact surface between bolt 16 at flange 27 and face 35 of the wedge 37 preferably is a great/large as possible and as close to a center line of the bolt 16 as operationally possible. Chamfer 24 preferably is present to aid in alignment during insertion of wedge 37 into lock bore 1 of the door 3.

FIG. 1 additionally illustrates tapered (pointed) stud distal end 23.

FIG. 9 additionally illustrates the inward (concave) chamfer 25 of the accessory bushing 32.

FIG. 4 additionally illustrates other associated elements, such as the door frame step molding 13, the door frame strike leg 14, seated as temporarily installed tapered shims 15*a* and 15*b* installed flush with the door edge 3' between the door 3, the rough opening wall linear stud 7 of the house, nails 16*a*, 16*b*, 16*c*, and a typical "rough opening" 10 between the door frame and an opening in the wall, and door frame step molding, and interior face 12 of the frame mounted door, and typical throat dimension 9 from a finished surface of a wall to an opposite wall.

FIG. 2 further illustrates the axial portion 31 of the cycloidal wrench wrenching-engagement end male camfer facilitating threatening the handle 38 into the hole 36 of the cycloidal wrench 37; a tapered end of the FIG. 2 stud bolt preferably has a tapered (camfered) end 23 to facilitate the threading thereof into the latch bore opening when threading through the lockset bore to the latch bore. Axial length of axial portion 31 must be merely long enough to "seat" the wedge contact top (engagement distal tool-end 35 having center face 34 having a convex camfer 41 thereof illustrated in FIG. 3; that axial portion 31 must have a cross-section at its contact meshing end-camfer to enable meshing therewith, the typical meshing shape of the end camfer 41 being illustrated in the FIG. 3 view. The handle 38 has an end-camfer 40 to facilitate the threading thereof into the handle receiving cycloidal wrench hole 36 of FIG. 2.

FIG. 10 additionally illustrates the inner passage space (here a through-space) and the passage inner wall 43, of the bolt 16.

FIG. 13 diagramatically and symbolically illustrates in elevation plan exploded side view with partial cut-away, male and female mateable separate proximal and distal stud shank portions.

In FIG. 13 diagramatically and symbolically in an elevation plan exploded side view with partial cut-away, male and female mateable separate proximal stud shank portion 43 and distal stud shank portion 44.

It is within the scope of the invention to make variation(s) and/or modification(s) within ordinary skill of the art of this subject matter.

I claim:

1. A door-hanger bolt assembly mounted within a door having a predetermined door's cylindrically-shaped latch bore comprising in combination:

a) an elongated tubular member having a cylindrical outer shape and having an open top end and an open bottom end inclusive of a substantially centered distal bottom structure forming an upwardly-extending first inner passage extending from said open bottom end distally toward said open top end, and inclusive of a substantially centered distal top structure forming a downwardly-extending second inner passage extending from said open top end distally toward said open bottom end, said open top end being formed by at-least one non-circular structure that is a part of said downwardly-extending second passage, said elongated tubular member having a cylindrically-shaped outer-wall having a predetermined outer diameter at-least as small as a diameter of the predetermined door's cylindrically-shaped latch bore, and b) a stud base member having a forward face of a radially-outwardly extending linear predetermined dimension greater than a diameter of a predetermined door's cylindrically-shaped latch bore of a door's latch bore structure, adapted to be mounted across a strike leg of a door frame's though-space strike aperture having a door frame strike aperture-diameter at-least as large as said predetermined outer diameter of said cylindrically-shaped outer-wall, said forward face including door frame strike leg-mounting means for mounting the forward face over the door frame's through-space strike aperture onto a door's frame strike leg-mounting outwardly-facing upright surface; a stud elongated member non-revolvably mounted on said forward face and the stud distally elongated member having a cross area shape and elongated member exterior walls thereto mountably retainably insertable into said upwardly-extending first inner passage, and said elongated member exterior walls including locking means for securing said stud elongated member within said first inner passage.

2. The door-hanger bolt assembly of claim 1, including a shim plate having opposite faces and having extending substantially centrally through the opposite faces a through-space having a substantially circular shape with a shim-hole diameter at-least as large as said diameter of said predetermined door's cylindrically-shaped latch bore, mountable between i) upper and lower strike legs of a door and ii) upper and lower strike legs of a door frame, said elongated tubular member being insertable through said shim hole and between strike legs of a door and strike legs of a door frame.

3. The door-hanger bolt assembly of claim 2, in which at-least a major distal end portion of said stud elongated member is removable from attachment to at-least one of said forward face and a proximal end of said stud elongated member.

4. The door-hanger bolt assembly of claim 3, in which said locking means comprises one of male and female threads is mounted on said stud elongated member, and in which a remaining one of said male and female threads is mounted on walls of said second inner passage, such that said male and female threads are detachably screwably mateable to and detachable from one another.

5. The door-hanger bolt assembly of claim 4, in which said first and second inner passages are serially and lineally interconnected.

6. The door-hanger bolt assembly of claim 5, including an extension member corresponding to a bottom-half of said elongated tubular member lineally detachably mountable on said open bottom end.

7. The door-hanger bolt assembly of claim 6, in which said stud elongated tube member includes a lateral face, in which the locking means includes at-least one raised wedge-structure raised from the lateral face, the raised wedge-structure being sufficiently raised as to securably anchor a inner tubular face of the elongated tube member such that the elongated tube member is retained in the mounted state.

8. The door-hanger bolt assembly of claim 7, including a revolvable cycloidal male wrench adapted for use in engagement and insertion of the elongated tubular member.

9. The door-hanger bolt assembly of claim 8, in which said cycloidal male wrench is a torque wrench.

10. The door-hanger bolt assembly of claim 3, in which said locking means comprises said stud elongated member includes lineally aligned proximal and distal end portions, shereably connected by an intermediate shearable stud-portion such that the distal end is shearable by a annularly twisting thereof relative to the proximal end portion held stationary by its mounted state within a latch bore of a door.

11. The door-hanger bolt assembly of claim 2, in which said shim space communicates with exterior lateral space, the shim plate having a substantially simicircular space extending through an edge of the shim plate.

12. The door-hanger bolt assembly of claim 1, in which at-least a major distal end portion of said stud elongated member is removable from attachment to at-least one of said forward face and a proximal end of said stud elongated member.

13. The door-hanger bolt assembly of claim 1, in which said locking means comprises one of male and female threads is mounted on said stud elongated member, and in which a remaining one of said male and female threads is mounted on walls of said second inner passage, such that said male and female threads are detachably screwably mateable to and detachable from one another.

14. The door-hanger bolt assembly of claim 1, in which said locking means comprises said stud elongated member includes lineally aligned proximal and distal end portions, shereably connected by an intermediate shearable stud-portion such that the distal end is shearable by a annularly twisting thereof relative to the proximal end portion held stationary by its mounted state within a latch bore of a door.

15. The door-hanger bolt assembly of claim 1, in which said first and second inner passages are serially and lineally interconnected.

16. The door-hanger bolt assembly of claim 1, including an extension member corresponding to a bottom-half of said elongated tubular member lineally detachably mountable on said open bottom end.

17. The door-hanger bolt assembly of claim 1, in which said stud elongated tube member includes a lateral face, in which the locking means includes at-least one raised wedge-structure raised from the lateral face, the raised wedge-structure being sufficiently raised as to securably anchor an inner tubular face of the elongated tube member such that the elongated tube member is retained in the mounted state.

18. The door-hanger bolt assembly of claim 1, including a cycloidal male wrench adapted for use in revolving the aforenoted elongated tubular member for the turning, disengagement and removal of the elongated tubular member from its engagement with the stud base member.

19. The door-hanger bolt assembly of claim 18, in which said cycloidal male wrench is a torque wrench.

* * * * *